US007568673B2

(12) United States Patent
Evingson

(10) Patent No.: US 7,568,673 B2
(45) Date of Patent: Aug. 4, 2009

(54) APPARATUS FOR SUSPENDING A RESERVOIR FOR DRYING

(75) Inventor: John Evingson, Lindstrom, MN (US)

(73) Assignee: John David Evingson, Anchorage, AK (US)

( * ) Notice: Subject to any disclaimer, the term of this patent is extended or adjusted under 35 U.S.C. 154(b) by 18 days.

(21) Appl. No.: 11/097,016

(22) Filed: Mar. 31, 2005

(65) Prior Publication Data

US 2006/0237614 A1 Oct. 26, 2006

(51) Int. Cl.
*B42F 13/00* (2006.01)
*A45F 5/00* (2006.01)

(52) U.S. Cl. ..... 248/339; 248/317; 248/342; 248/304; 248/58; 248/220.21; 248/220.22; 224/148.2; 224/148.5; 220/375; 220/175

(58) Field of Classification Search ..... 248/339, 248/317, 342, 304, 62, 63, 75, 58, 220.21, 248/220.22; 224/148.2, 148.5; 220/375, 220/175

See application file for complete search history.

(56) References Cited

U.S. PATENT DOCUMENTS 4,552,396 A * 11/1985 Rais ..... 294/27.1
4,896,913 A * 1/1990 Kennedy ..... 294/31.2
D357,813 S * 5/1995 Koresko ..... D6/317
D371,943 S * 7/1996 Ramirez ..... D7/622
D440,496 S * 4/2001 Adam et al. ..... D7/622
D488,997 S * 4/2004 Angeletta ..... D8/373
6,820,780 B2 * 11/2004 Forsman et al. ..... 224/148.2

OTHER PUBLICATIONS

Camelbak. Reservior Dryer. www.camelbak.com/rec/cb_prod.cfm?catid=6&product_id=44 (Accessed Mar. 31, 2005).
International Written Opinion of the International Searching Authority for Application No. PCT/US06/11042, mailed Nov. 21, 2007.

* cited by examiner

*Primary Examiner*—J. Allen Shriver
*Assistant Examiner*—Todd M. Epps

(57) ABSTRACT

A suspender for a fluid reservoir having a drinking tube includes a grip structurally coupled to a hanger. The grip is oriented to hold the drinking tube and the hanger configured to support a weight of the reservoir. The reservoir includes flexible walls forming a compartment for holding a liquid. An expander for the reservoir includes a body insertable inside the compartment through an opening defined by a collar of a fill port. Formed on the body are a first collar engaging surface and a second collar engaging surface. The collar engaging surface are separated by a distance substantially equal to a width of the opening. An expansion member, integral to the body, is oriented to maintain at least a partial separation between the flexible walls when the body is inserted inside the compartment and the first and second collar engaging surfaces are engaging the collar.

10 Claims, 11 Drawing Sheets

APPARATUS FOR SUSPENDING A RESERVOIR FOR DRYING

BACKGROUND

Personal hydrations systems help athletes maintain adequate hydration while engaging in strenuous physical activities, such as running, cycling, skiing, hiking, or mountain climbing. These personal hydration systems typically include a bag-like reservoir carried in a back pack or waist pack. A flexible drinking tube connects to the reservoir through an exit port at one end and terminates in a mouthpiece at the other end. The tube is long enough to allow the mouthpiece to be carried in the user's mouth to enable the user to draw water from the reservoir at will. Such reservoirs can prove difficult to clean as access to the interior of the reservoir is limited. The limited access can also render drying the interior of the reservoir an unwelcome task.

DESCRIPTION OF THE DRAWINGS

FIG. 1. is a top plan view, while FIG. 2 is a side elevation view.

DETAILED DESCRIPTION

Introduction: Various embodiments of the present invention assist in drying a personal hydration system. As bacteria can thrive in dark, moist places, drying the interior of the hydration system after use and cleaning helps maintain a sanitary condition. The following description is broken into sections. The first provides an example of a personal hydration system. The second section, labeled "components," describes an exemplary suspender and an exemplary expander that can be used to assist in drying a personal hydration system. The last section, labeled "use," provides examples of the suspender and expander in use.

Figure 1:
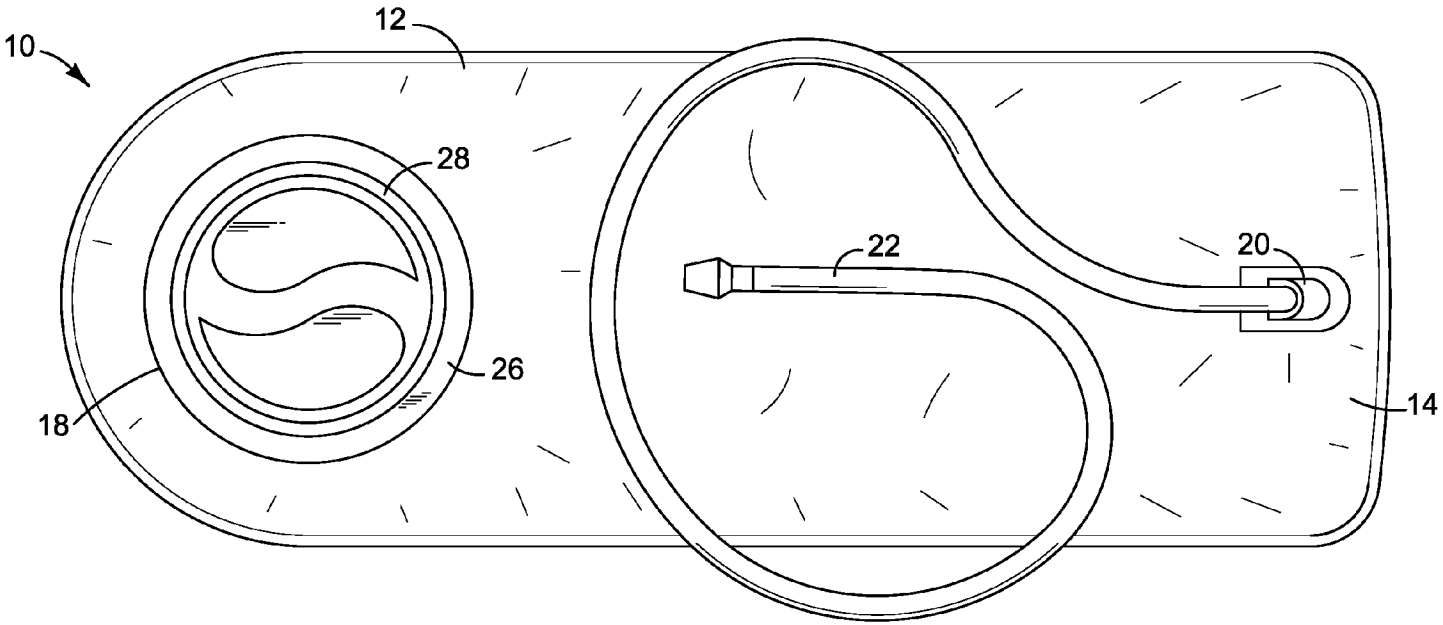
FIGS. 1 and 2 illustrates an exemplary a personal hydration system in the form of a reservoir.
Figure 2:
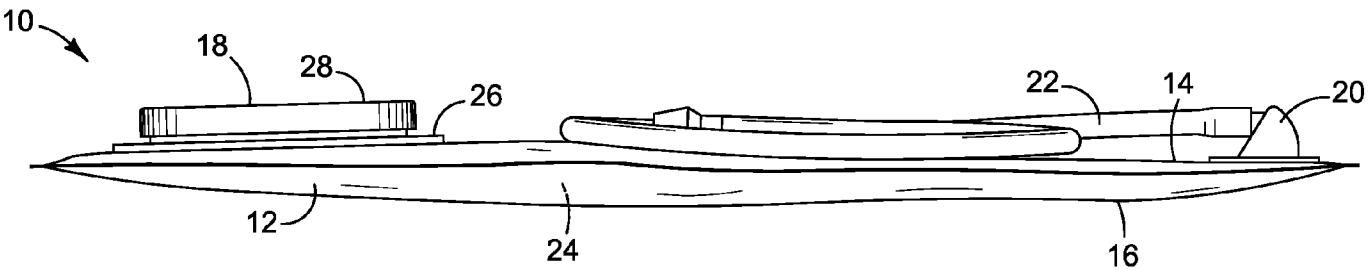

Personal Hydration System: FIGS. 1 and 2 illustrate an exemplary personal hydration system in the form of reservoir 10. Reservoir 10 includes bladder 12 formed by opposing walls 14 and 16 (seen best in FIG. 2), fill port 18, exit port 20, and drinking tube 22. Walls 14 and 16 form an internal compartment 24 adapted to store a volume of fluid such as water. Walls 14 and 16 can be formed from a flexible, waterproof material. An example of a suitable material is polyurethane, although others may be used. The size and shape of compartment 24 may vary, such as depending upon the desired application with which the system will be used, any pack into which reservoir 10 will be placed, the mechanism by which the reservoir 10 will be transported, and the volume of drink fluid that compartment 24 is designed to hold.

The length of drinking tube 22 may vary depending upon the desired distance between the user's mouth and the location where reservoir 10 is positioned, such as on a user's back, waist, inside a user's garments, on a user's bike or other equipment. An end of drinking tube 22 is connected to reservoir 10 at exit port 20 through which fluid in compartment 24 is received into tube 22. In other words, compartment 24 is in fluid communication with exit port 20.

Reservoir 10 includes fill port 18 through which fluid may be poured into or removed from compartment 24. Fill port 18 also provides an opening through which compartment 24 may be accessed for cleaning. As shown, fill port 18 includes collar 26 and cap 28. Collar 26 is sealed to wall 14. Cap 28 is removeably sealed to collar 26. For example, collar 26 and cap 28 may include mating threads and a gasket allowing cap 28 to be twisted off to be separated from collar 26 and twisted on to be sealed to collar 26. With cap 28 removed, a fluid can be poured into compartment 24 through collar 26 of fill port 18. Cap 28 can then be sealed to collar 26 securing the fluid in compartment 24. User supplied suction applied to drinking tube 22 can then pull the fluid out of compartment 24 through exit port 20.

Components: The components of an exemplary system for drying a personal hydration system such as reservoir 10 (FIGS. 1 and 2) will be described with reference to FIGS. 3-6 as well as FIGS. 1 and 2. The system includes a suspender for suspending reservoir 10 in a hanging position and an expander for maintaining a separation of walls 14 and 16 improving air to circulation within compartment 24 assisting in the drying of reservoir 10.

Figure 3:
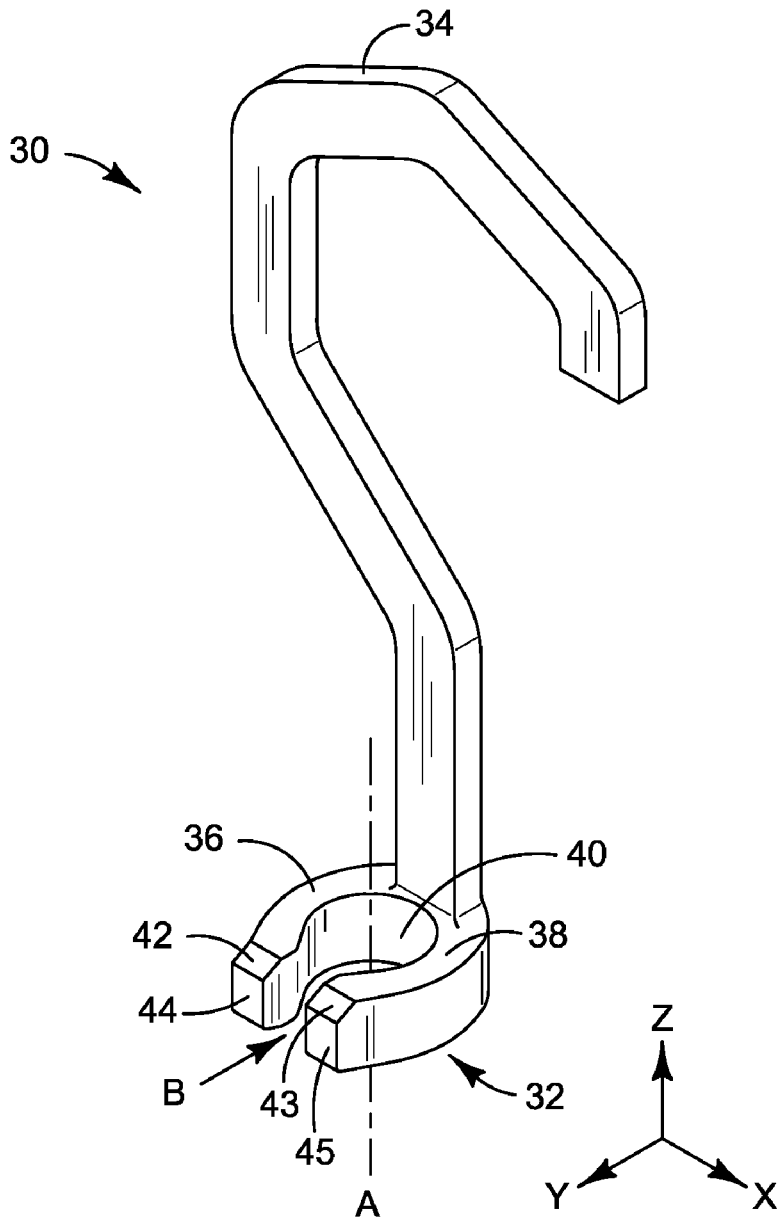
FIGS. 3 and 4 illustrate a suspender according to an embodiment of the present invention.

FIG. 3 provides a perspective view of an exemplary suspender 30. As shown suspender 30 includes grip 32 and hanger 34. Grip 32 represents a structure capable of holding or otherwise securing drinking tube 22. Hanger 34 represents a structure capable securing suspender 30 to a support body such as a closet rod, thus, suspending reservoir 10 with grip 32 holding drinking tube 10.

As illustrated hanger 34 is, but need not be, a hook. Hanger 34 may be any other suitable structure capable of securing suspender 30 to a support body. Alternative examples include a clamp or an adhesive surface. Grip 32 is shown to include opposing arms 36 and 38 defining retention slot 40 for at least partially surrounding a portion of drinking tube 22 (see FIG. 4). Drinking tube 22 extending along axis (A) can be urged in an entry direction (B) until it is in retention slot 40 surrounded by arms 36 and 38. The opening between arms 36 and 38 may be narrower than a diameter of the drinking tube 22. In such a case, drinking tube 22 will compress at least slightly as it is fitted into retention slot 40.

Figure 4:
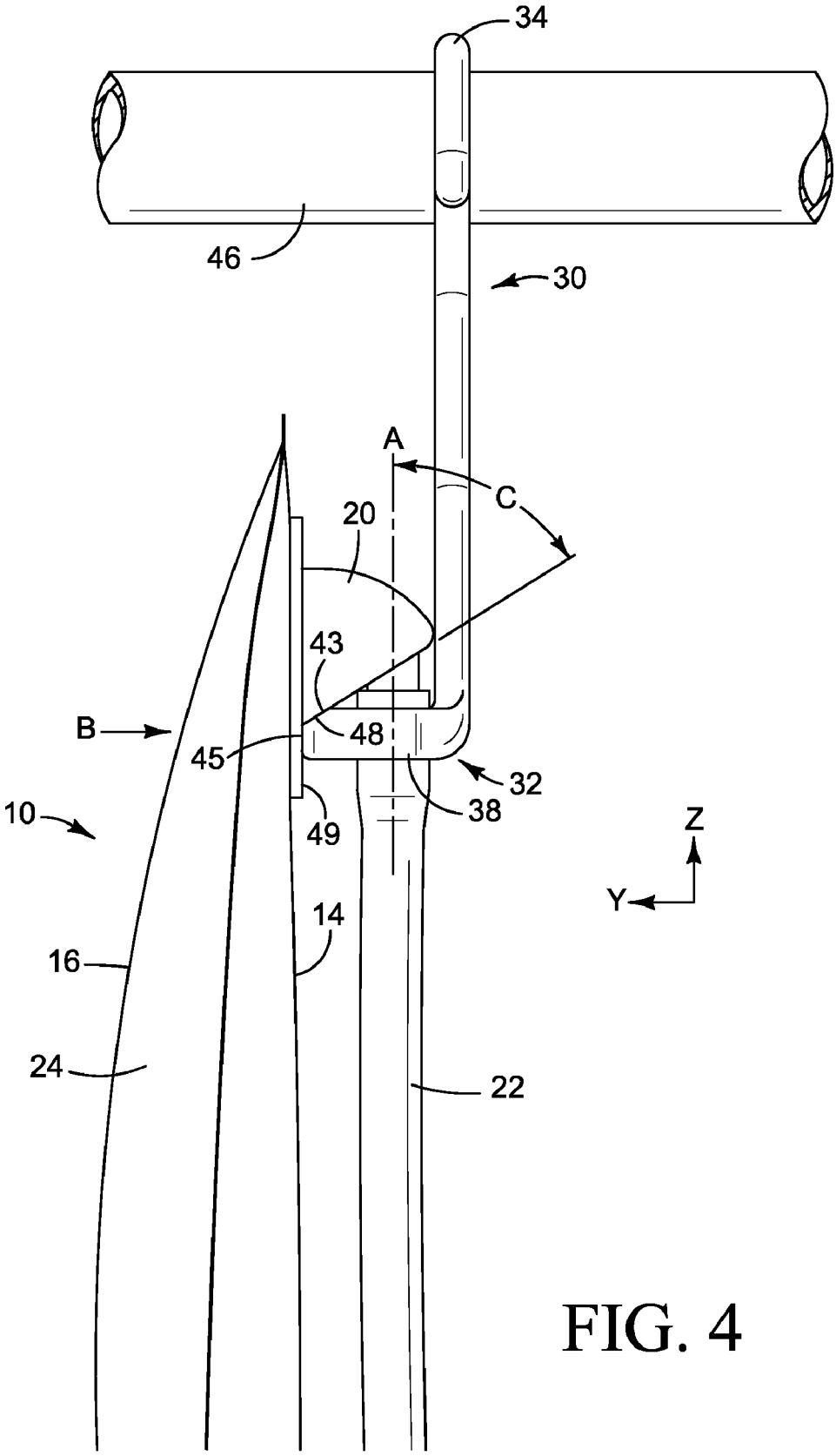

Arms 36 and 38 each include a beveled mating surface 42 and 43 and engaging surfaces 44 and 45, the purpose of which is made clear in FIG. 4 where suspender 30 is shown suspending reservoir 10. Hanger 34 is securing suspender 30 to support body 46, and grip 32 is holding drinking tube 22 at exit port 20 of reservoir 10. Exit port 20 is shown to include port surface 48 and reservoir surface 49. As illustrated, drinking tube 22 extends outward from a port surface 48 of the exit port 18 along axis (A). Reservoir surface 49 is fixed to wall 14. Axis (A) is oriented relative to a plane defined by port surface 48 at an angle (C). As illustrated, reservoir surface 49 is generally parallel to axis (A). Beveled mating surfaces 42 and 43 are beveled at an angle selected such that surfaces 42 and 43 are parallel with and engage port surface 48 when grip 32 holds drinking tube 22 at exit port 20. In other words, angle (C) is also the angle between axis (A) and a plane defined by beveled surfaces 42 and 43 when grip 32 is holding drinking tube 22 at exit port 20 and surfaces 42 and 43 are engaging port surface 48. Engaging surfaces 44 and 45 engage reservoir surface 49 when grip 32 holds drinking tube 22 at exit port 20 and beveled mating surfaces 42 and 43 engage port surface 48.

Orthogonal axes X, Y, and Z are shown in FIGS. 3 and 4 and defining three orthogonal planes—X/Y, X/Z, and Y/Z. As illustrated, arms 42 and 43 of grip 32 fill a first plane parallel to the X/Y plane. Hanger 34 is a hook that fills a second plane parallel to the X/Z plane. The first and second planes, then, are perpendicular to one another. Arms 42 and 43 are oriented to define an entry direction (B)—the direction in which drinking tube 22 is urged into retention slot 40. Entry direction (B) is parallel to the Y axis and to the first plane. Retention slot 40 has an axis (A) that is parallel to the Z axis and to the second plane. Reasons for this particular orientation are made clear below with reference to FIGS. 10 and 11.

Figure 5:
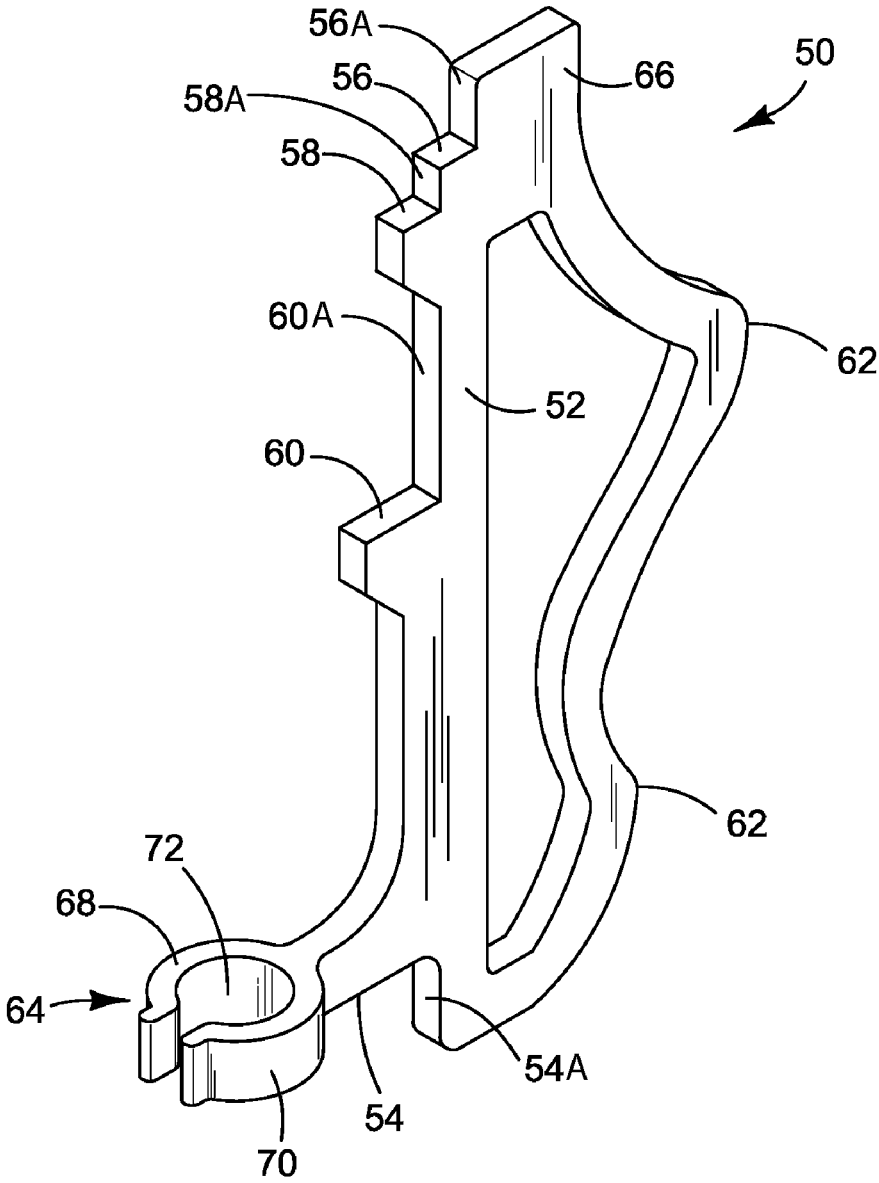
FIGS. 5 and 6 illustrate an expander according to an embodiment of the present invention.
Figure 6:
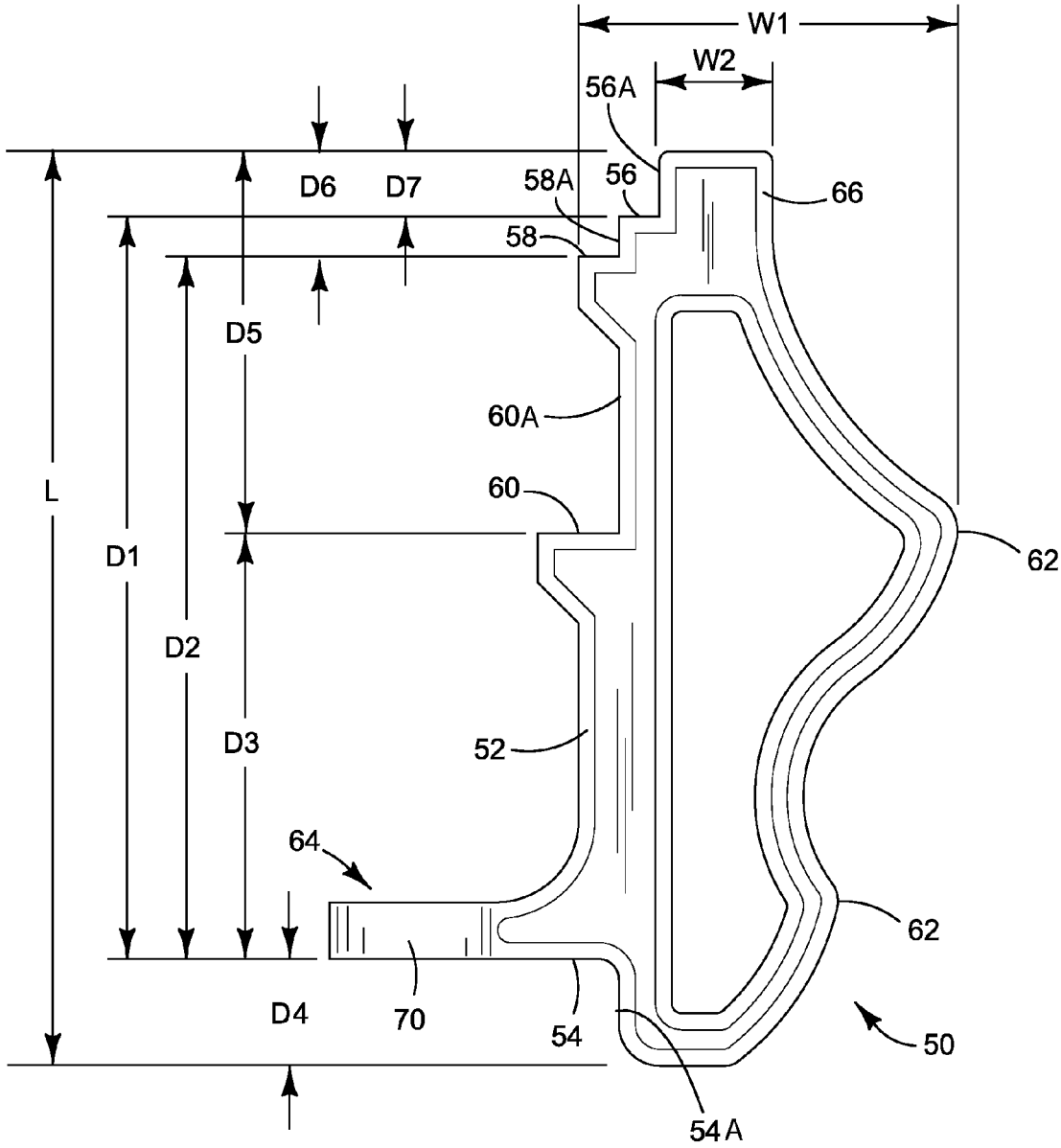

Moving on, FIGS. 5 and 6 illustrate an exemplary expander 50. Expander 50 is shown to include a main body 52 insertable through collar 26 of fill port 18 (See FIGS 1 and 2). Formed on body 52 are collar engaging surfaces 54, 56, 58, and 60 and surfaces 54A, 56A, 58A, and 60A. As one can see in FIGS. 5 and 6, surface 54A is adjacent and generally perpendicular to surface 54. Surface 56A is adjacent and generally perpendicular to surface 56. Surface 58A is adjacent and generally perpendicular to surface 58, and surface 60A is adjacent and generally perpendicular to surface 60. Integral to body 52 is expansion member 62, grip 64, and tab 66.

Collar engaging surfaces 54-60 can be broken into opposing pairs 54/56, 54/58, and 54/60 with each surface 54-60 representing a surface capable of engaging a portion of collar 26. Referring to FIG. 6, opposing collar engaging surfaces 54/56 are separated by a distance (D1). Opposing collar engaging surfaces 54/58 are separated by a distance (D2), and opposing collar engaging surfaces 54/60 are separated by a distance (D3). Distance (D1), for example, may correspond to a width or diameter an opening defined by collar 26 of reservoir 10. As will be shown, with expander 50 inserted into compartment 24 of reservoir 10, opposing collar engaging surfaces 54 and 56 each engage a portion of collar 26 and help secure expander 50 in a position allowing expansion member 62 to separate wall 16 from wall 14. Distances (D2) and (D3) correspond to the widths or diameters of fill port opening of other types or styles of personal hydration systems. In this way, expander 50 is not limited to use with reservoir 10 but may be used with other types of reservoirs having variously sized fill port openings.

Referring to FIG. 5, grip 64, like grip 32 of suspender 30 (FIGS. 3 and 4), is responsible for holding drinking tube 22 (see FIGS. 1 and 2). As shown, grip 64 includes opposing arms 66, 68 defining retention slot 70 for at least partially surrounding a portion of drinking tube 22 (see FIG. 9). The opening between arms 66 and 68 may be narrower than a diameter of drinking tube 22. In such a case, drinking tube 22 will compress at least slightly as it is fitted into retention slot 70. Grip 64 is oriented relative to the rest of body 52 such that when expander 50 is inserted into reservoir 10, grip 64 can extend back out of reservoir 10 through fill port 18. This can best be seen in FIG. 8 discussed below.

Referring again to FIG. 6, body 52 of expander 50 has a dimension (W1) selected to be less that distance (D3). Where body 52 is rigid, dimension (W1) defines, within a given tolerance, the minimum size of a reservoir fill port opening through which expander 50 can be inserted. If body 52 is flexible, it could be compressed to fit through an even smaller fill port opening. Note that body 52 has a length (L) measured perpendicular to the width (W1). That length (L) can be referred to as an length (L) as it corresponds to a length of body 52 that is configured to be inserted through a fill port and into a reservoir. That length (L) is greater than distances D1, D2, and D3. As such that length (L) is greater than the widths or diameters of the fill port openings corresponding to distances D1, D2, and D3. In this manner, as shown below with respect to FIGS. 7-9, body 52, when oriented properly can be inserted through a fill port. The length (L) of body 52 is greater than the diameter of that fill port. So when body 52 is inserted through the fill port into the reservoir and reoriented to a position such that the length (L) of body 52 is parallel to the width of the fill port, that length (L) prevents body 52 from being pulled back through the fill port. Furthermore, as can be seen from FIG. 6, L=D1+D4+D7=D2+D4+D6=D3+D4+D5.

Tab 66 represents a structure for use in coupling expander 50 to suspender 30 so that the two can be compactly stored. Tab 66 has a dimension (W2) that corresponds to a width of retention slot 40 of grip 32 (see FIG. 3) Tab 66 can then be inserted into retention slot 40 coupling expander 50 to suspender 30. Friction between arms 36/38 and tab 66 help prevent expander 50 from inadvertently separating from suspender 30. This can best be seen in FIGS. 10 and 11 discussed below.

Figure 7:
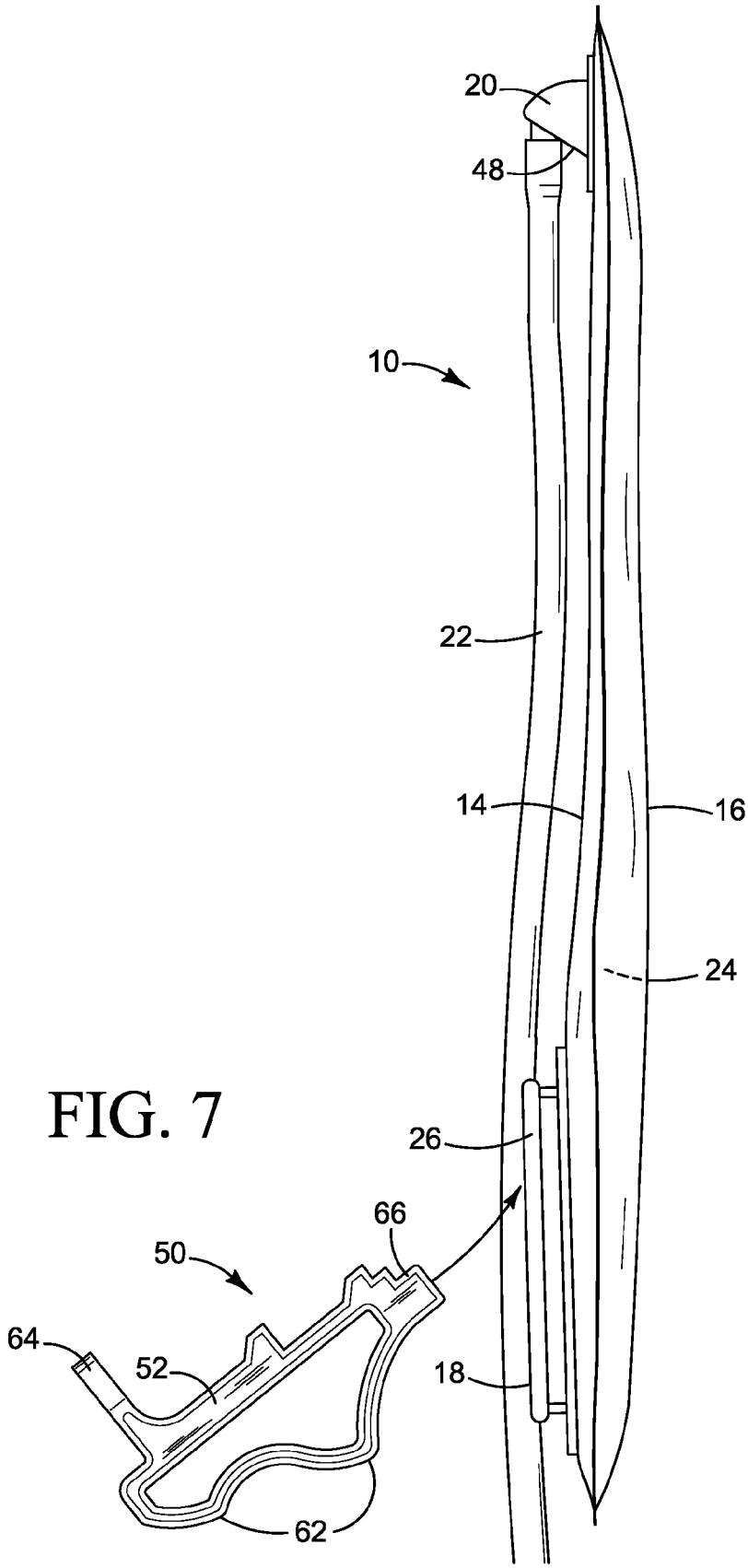
FIGS. 7 and 8 illustrate an expander being inserted into a reservoir according to an embodiment of the present invention.
Figure 8:
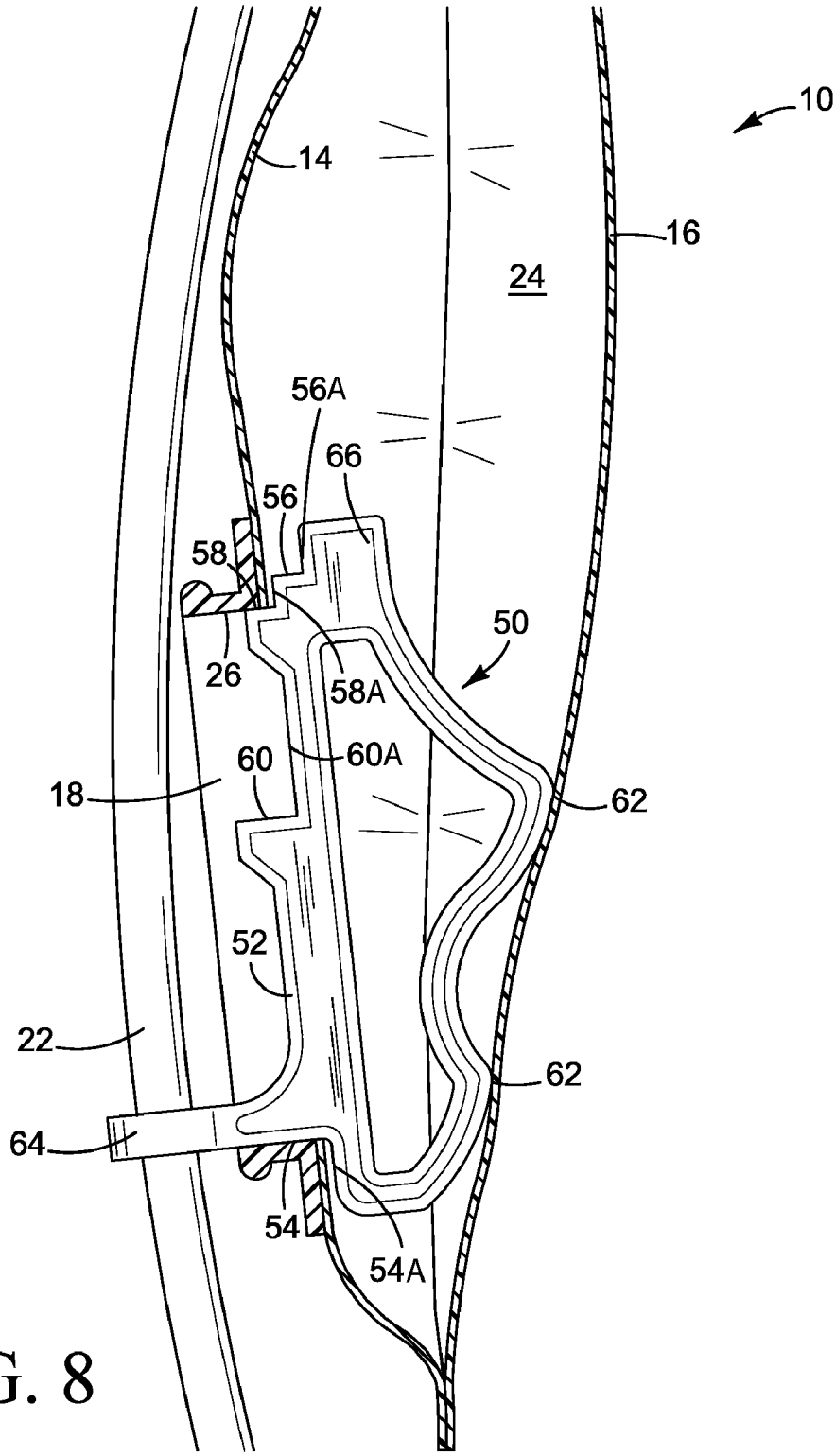

Use: FIGS. 7 and 8 illustrate the insertion of expander 50 into compartment 24 or reservoir 10. Starting with FIG. 7, cap 28 (shown in FIGS. 1 and 2) has been removed from collar 26 of fill port 18 creating an opening into compartment 24. Like inserting a foot—toes first—into a shoe, expander 50 is inserted tab 66 first through the opening defined by collar 18.

Moving to FIG. 8, body 52 of expander 50 has been inserted into compartment 24 with only grip 64 extending out through the opening defined by collar 26. Cap 28 (not shown here) has been removed from collar 26. Opposing collar engaging surfaces 54/58 are engaging collar 26. Surfaces 54A and 58A extend beyond the diameter of fill port 18 preventing body 52 from being removed from compartment 24 unless body 52 is reoriented. It is noted that if collar 26 were smaller, it might be instead engaged by opposing collar engaging surfaces 54/56 or 54/60. Where collar 26 is engaged by surfaces 54/56, surfaces 54A and 56A extend beyond the diameter of fill port 18 preventing body 52 from being removed from compartment 24 unless body 52 is reoriented. Where collar 26 is engaged by surfaces 54/60, surfaces 54A and 60A extend beyond the diameter of fill port 18 preventing body 52 from being removed from compartment 24 unless body 52 is reoriented. Thus as mentioned above, the length (L) of body 52 is greater than the diameter of fill port 18. So when body 52 is inserted through fill port 18 into the reservoir and reoriented to a position such that length (L) of body 52 is parallel to the diameter of fill port 18, collar engaging surfaces 54/58 can engage collar 26. As seen in FIG. 8, this allows surfaces 54A and 58A to extend beyond that fill port diameter and prevent body 52 from being pulled back through the fill port 18 unless body 52 is reoriented. Expansion member 62 is separating wall 16 from wall 14 creating an air gap within compartment 24. This gap allows increased air circulation through compartment 24 aiding in the drying of reservoir 10.

Figure 9:
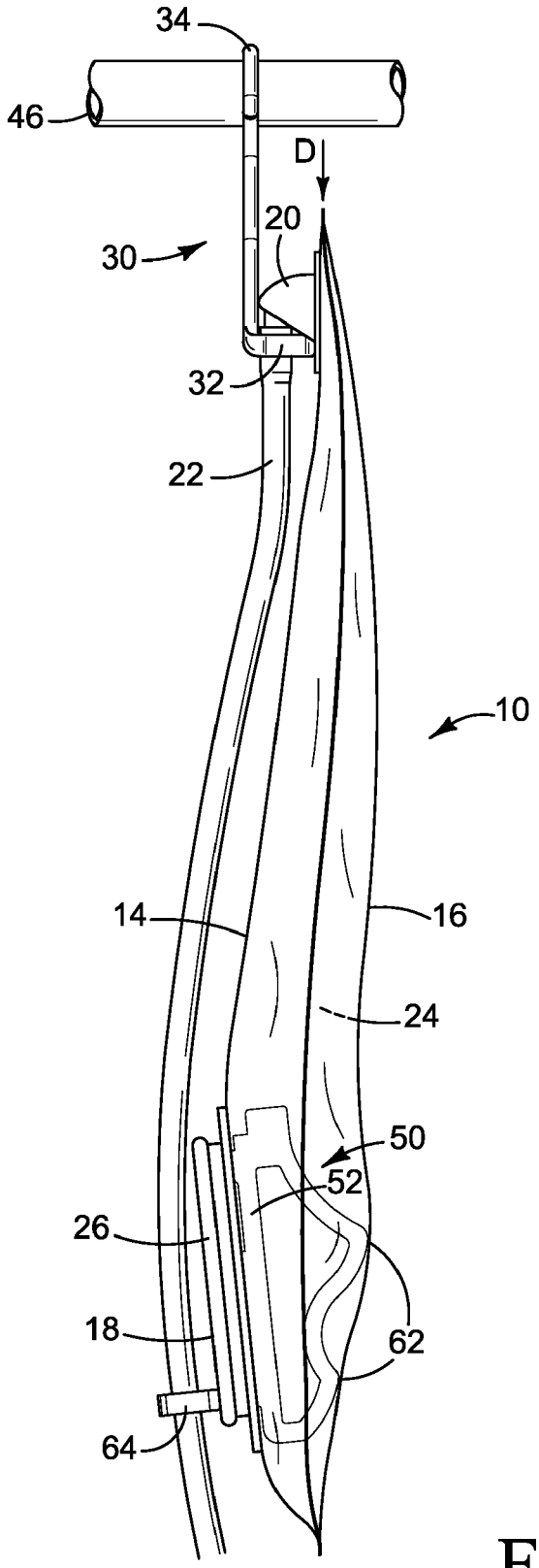
FIG. 9 illustrates an expander inserted in a reservoir being held by a suspender according to an embodiment of the present invention.

In FIG. 9, suspender 30 is suspending reservoir 10. Grip 32 is holding drinking tube 22 at exit port 20. Hanger 34 is coupled to support body 46. Grip 66 of expander 50 is also holding drinking tune 22. With the force of gravity pulling downward on suspended reservoir 10 in direction (D), expansion member 62 of expander 50 maintains an air pocket within compartment 24, separating walls 14 and 16. Air is then allowed to circulate in and out through the opening defined by collar 26 aiding in the drying of compartment 24.

Figure 10:
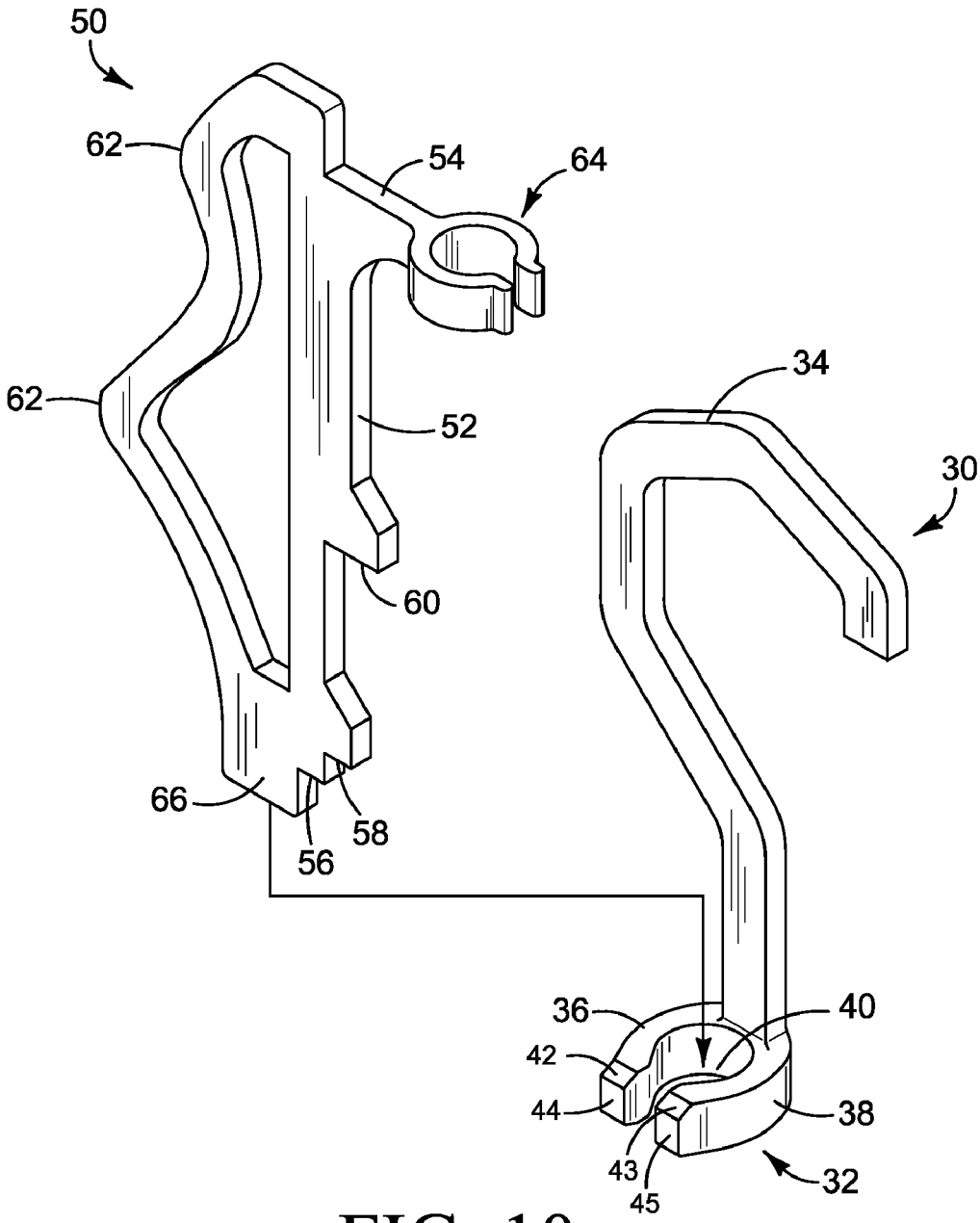
FIGS. 10-12 illustrate the expander being coupled to the suspender for storage or transport according to an embodiment of the present invention.
Figure 11:
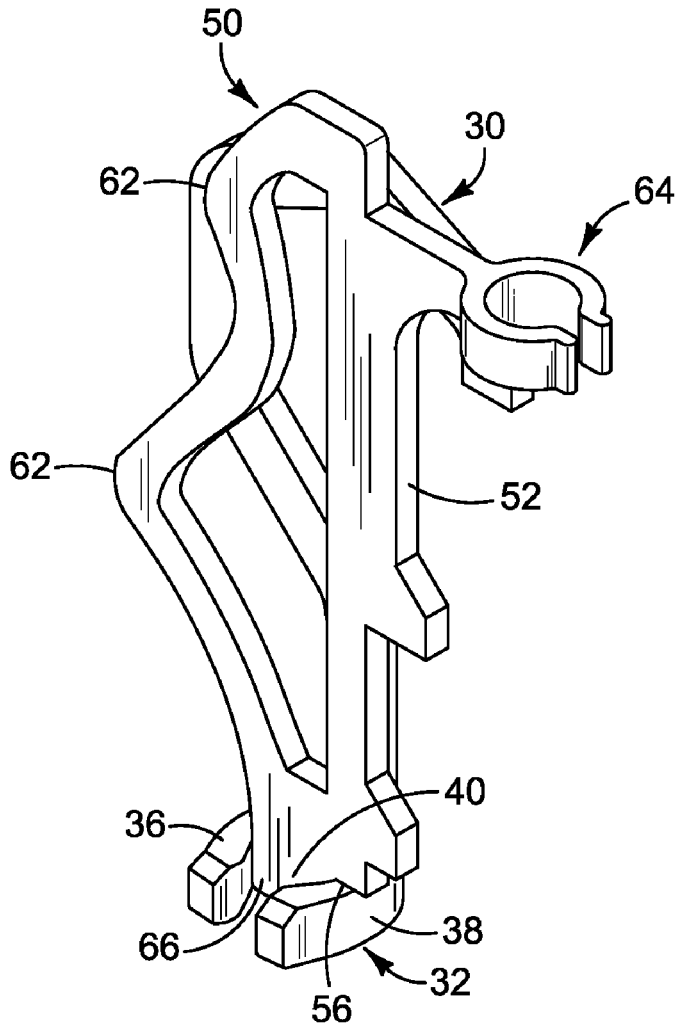

Moving on to FIGS. 10 and 11 expander 50 is designed to couple to suspender 30 for storage or transport. As discussed above, tab 66 of expander 50 is designed to fit within retention grip 32 of suspender 30. More specifically, tab 66 is sized to fit snugly sliding into and out of retention slot 40 of grip 32. Grip 32 is oriented relative to hanger 34 of suspender 30 so that when tab 66 is inserted into retention slot 40, body 52 of expander 50 is parallel with hanger 34. This parallel orientation is compact allowing the coupled expander 50 and suspender 30 to be easily stored or transported.

Figure 12:
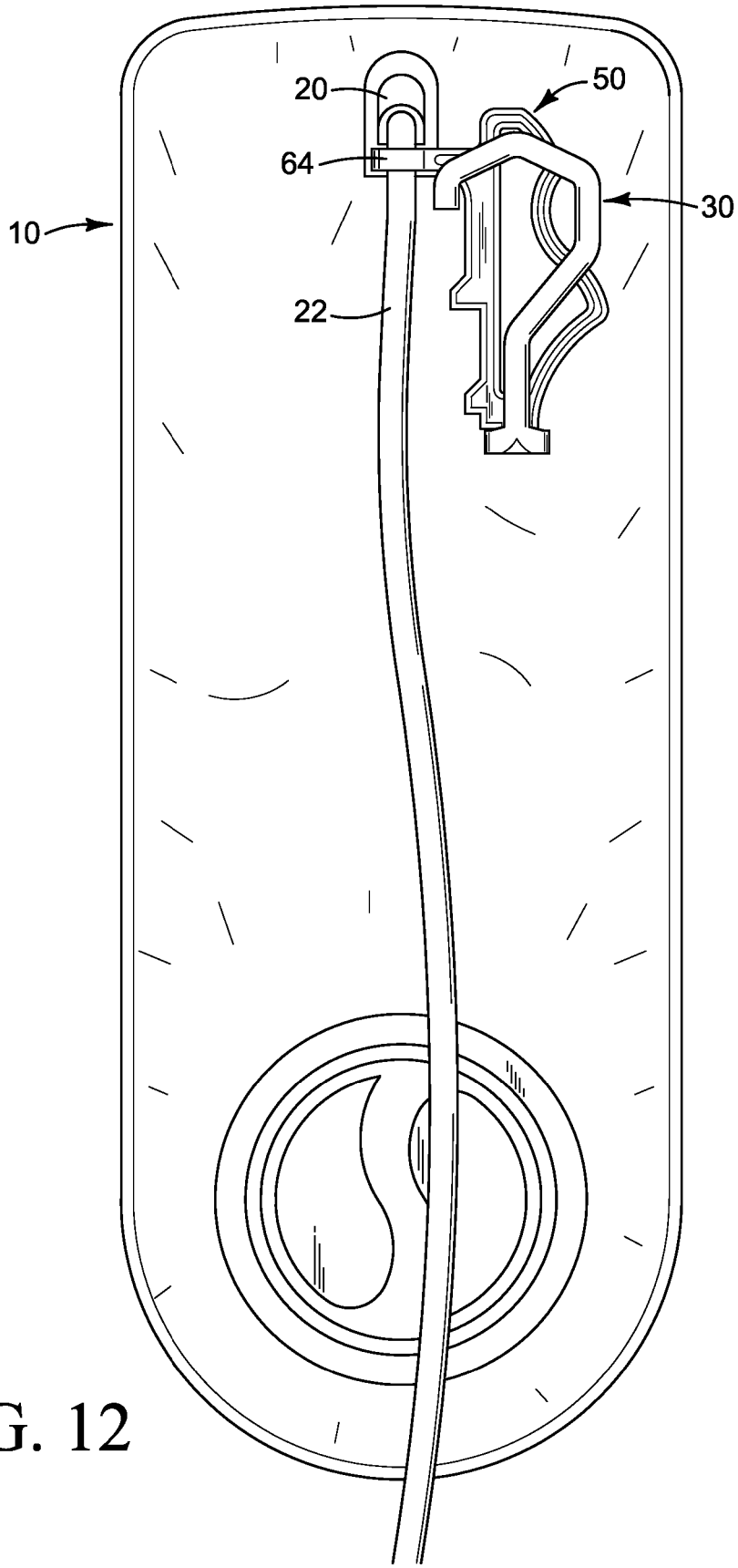

Moving to FIG. 12, expander 50 is shown coupled to suspender 30 with grip 64 holding drinking tube 22 at exit port 20 of reservoir 10. In this manner expander 50 and suspender 30 can be easily stored when not in use. Coupled expander 50 and suspender 20 are safely hidden away but easily retrievable when reservoir 10 is placed inside a pack during use.

Conclusion: Embodiments of the present invention have been shown and described with reference to the foregoing exemplary embodiments. It is to be understood, however, that other forms, details, and embodiments may be made without departing from the spirit and scope of the invention which is defined in the following claims.

What is claimed is:

1. A system for drying a fluid reservoir having opposing flexible walls forming a compartment for containing a liquid, a drinking tube, and a fill port, the system comprising: a suspender and an expander, wherein:

the suspender comprises: a first grip structurally coupled to a hanger, the grip oriented to hold the drinking tube and the hanger configured to support a weight of the reservoir; and the expander comprises:

a body insertable into the compartment through an opening defined by a collar, the collar defining the fill port of the reservoir, the body having a width and an length;

a first surface and an opposing second surface each formed on the body, the first and second surfaces configured to engage the collar, the first and second surfaces being separated by a first distance substantially equal to a diameter of the opening, the first distance being less than the length and greater than the width;

a third surface formed on the body, the third surface adjacent and generally perpendicular to the first surface; and a fourth surface formed on the body, the fourth surface adjacent and generally perpendicular to the second surface;

wherein the expander is configured such that when the body is inserted into the compartment and oriented such the first and second surfaces engage the collar, the third and fourth surfaces prevent the body from being removed from the compartment unless the body is reoriented.

2. The system of claim 1, wherein the expander comprises:

an expansion member integral to the body and oriented to maintain at least a partial separation between the opposing flexible walls when the body is inserted inside the compartment and when the first and second surfaces are engaging the collar.

3. The system of claim 2, wherein the expander further comprises a third surface formed on the body and opposing the first surface, the first and third surfaces being separated by a second distance not equal to the first distance, the second distance being less than the length.

4. The system of claim 2 wherein the expander includes a tab integral to the body and insertable into the first grip to couple the expander to the suspender.

5. The system of claim 4, wherein the first grip comprises a first pair of opposing arms defining a retention slot for at least partially surrounding a portion of the drinking tube and define a first plane, the opposing arms providing a gap for receiving the drinking tube from an entry direction that is substantially parallel to the first plane; and the hanger comprises a hook defining a second plane that is substantially perpendicular to the entry direction.

6. The system of claim 5, wherein the body of the expander defines a third plane, the third plane being substantially parallel to the second plane when the tab is inserted in the first grip.

7. The system of claim 1, wherein the expander includes a second grip integral to the body and positioned to extend out of the compartment through the fill port when the body is inserted inside the compartment and when the first and second surfaces are engaging the collar, the second grip being oriented to hold the drinking tube.

8. The system of claim 7, wherein the first grip comprises a first pair of opposing arms defining a first retention slot for at least partially surrounding a first portion of the drinking tube; and the second grip comprises a second pair of opposing arms defining a second retention slot for at least partially surrounding a second portion of the drinking tube.

9. The system of claim 1, wherein the grip is oriented to hold the drinking tube at the exit port of the reservoir.

10. The system of claim 1, wherein the grip comprises opposing arms defining a retention slot for at least partially surrounding a portion of the drinking tube; and each arm includes a beveled mating surface oriented at an angle selected so that the beveled mating surfaces of each arm are substantially parallel with and capable of engaging the port surface of an exit port of the reservoir when the retention slot is at least partially surrounding a portion of the drinking tube at the exit port.

* * * * *